United States Patent [19]

Bettcher, Jr.

[11] Patent Number: 4,777,899

[45] Date of Patent: Oct. 18, 1988

[54] HYDRAULICALLY ACTUATED FIN STABILIZER SYSTEM

[75] Inventor: Carl W. Bettcher, Jr., Woodbury, Conn.

[73] Assignee: Van Dusen & Meyer, Shelton, Conn.

[21] Appl. No.: 28,343

[22] Filed: Mar. 20, 1987

[51] Int. Cl.[4] ..... B63B 39/04; B63B 39/06

[52] U.S. Cl. ..... 114/122; 114/126

[58] Field of Search ..... 114/126, 122, 121, 275; 137/38; 244/78-80

[56] References Cited

U.S. PATENT DOCUMENTS 2,960,959 11/1960 Chadwick, Jr. et al. ..... 114/126
3,071,337 1/1963 Harcum ..... 244/78
3,476,129 11/1969 Halstenberg ..... 244/79 X

*Primary Examiner*—Sherman D. Basinger
*Attorney, Agent, or Firm*—Samuels, Gauthier, Stevens & Kehoe

[57] ABSTRACT

A hydraulically actuated fin stabilizer system for counteracting the tendency of a ship to experience rolling and/or list or side sway, wherein a gyroscopic sensor and a pendulum type sensor are either hydraulically or mechanically coupled to generate an integrated differential hydraulic signal used to control the adjustment of stabilizing fins.

6 Claims, 2 Drawing Sheets

HYDRAULICALLY ACTUATED FIN STABILIZER SYSTEM

BACKGROUND OF THE INVENTION

1. Field of the Invention

This invention relates to a fin stabilizer system for counteracting roll and/or list or side away of a ship at sea.

2. Description of the Prior Art

U.S. Pat. No. 3,756,262 discloses a known stabilizer system for counteracting roll while a ship is under way. In this type of system, the rate of vessel roll is sensed by a hydraulically driven rate gyroscope. The gyroscope generates differential hydraulic pressure control signals which are used to adjust external submerged fin stabilizers. While such systems have proven to be highly effective in counteracting roll, they lack the capability of also detecting and effectively counteracting list and side sway.

Other known systems of the type disclosed for example in U.S. Pat. No. 3,897,717 employ pendulum type sensors to detect changes in the attitude of a structure such as for example an instrument platform. In this type of system, the pendulum swings between and serves as a common obstructing member for a pair of confronting flow restrictors. The restrictors are fixed in relation to the structure and are incorporated into a hydraulic control circuit connected to a hydraulic linear actuator. The linear actuator is mechanically connected to the platform and operates in response to control signals from the pendulum type sensor. As long as the structure remains properly oriented, the pendulum remains centrally positioned between the restrictors, the hydraulic pressure across the restrictors remains in balance and the linear actuator remains passive. In the event that the structure undergoes an undesirable change in attitude, the positions of the restrictors will change in relation to the relatively stationary pendulum, thereby upsetting the balance of hydraulic fluid flow therethrough. The resulting differential fluid pressure serves as a control signal which operates the actuator to return the structure to the desired attitude. This type of system is effective in counteracting very gradual changes in attitude, e.g., listing or side sway of a ship at sea, but is incapable of effectively counteracting rolling due to the fact that the corrective action derived from the pendulum sensor is always 90° out of phase with each change in the direction of roll.

The basic objective of the present invention is to provide an improved fin stabilizer system having the capability of counteracting vessel roll and/or list or side sway conditions.

SUMMARY OF THE INVENTION

The fin stabilizer system of the present invention incorporates both a rate gyroscope sensing device and a pendulum type sensing device. The rate gryoscope sensing device generates a first output signal representative of roll direction and rate, while the pendulum type sensing device generates a second output signal representative of list or side sway. The first and second output signals are combined into an integrated output signal which is employed to control hydraulic actuators mechanically coupled to the stabilizer fins.

In one embodiment of the invention, the first and second output signals constitute differential hydraulic pressures which are hydraulically combined into an integrated hydraulic output signal. In another embodiment of the invention, the first and second output signals constitute torsional forces which are applied to a common shaft and are thus mechanically coupled to again generate an integrated hydraulic output signal.

The resulting system is totally flexible and capable of dealing with a variety of sea conditions. For example, when rolling conditions predominate and the tendency to experience listing or side sway is minimal, the hydraulically actuated fin stabilizers will be controlled primarily by the first output signal of the rate gyroscope sensing device, with the pendulum-type sensing device remaining largely inactive. The reverse will apply when rolling conditions are minimal in comparison to list or side sway, i.e., the fin stabilizers will respond primarily to the second output signal of the pendulum-type sensing device. More often as not, however, a combination of rolling and listing or side sway conditions will prevail, in which case the system will respond in a self-modulating manner by appropriately combining the first and second output signals of both sensing devices into the required integrated output signal.

DETAILED DESCRIPTION OF ILLUSTRATED EMBODIMENTS

Figure 1:
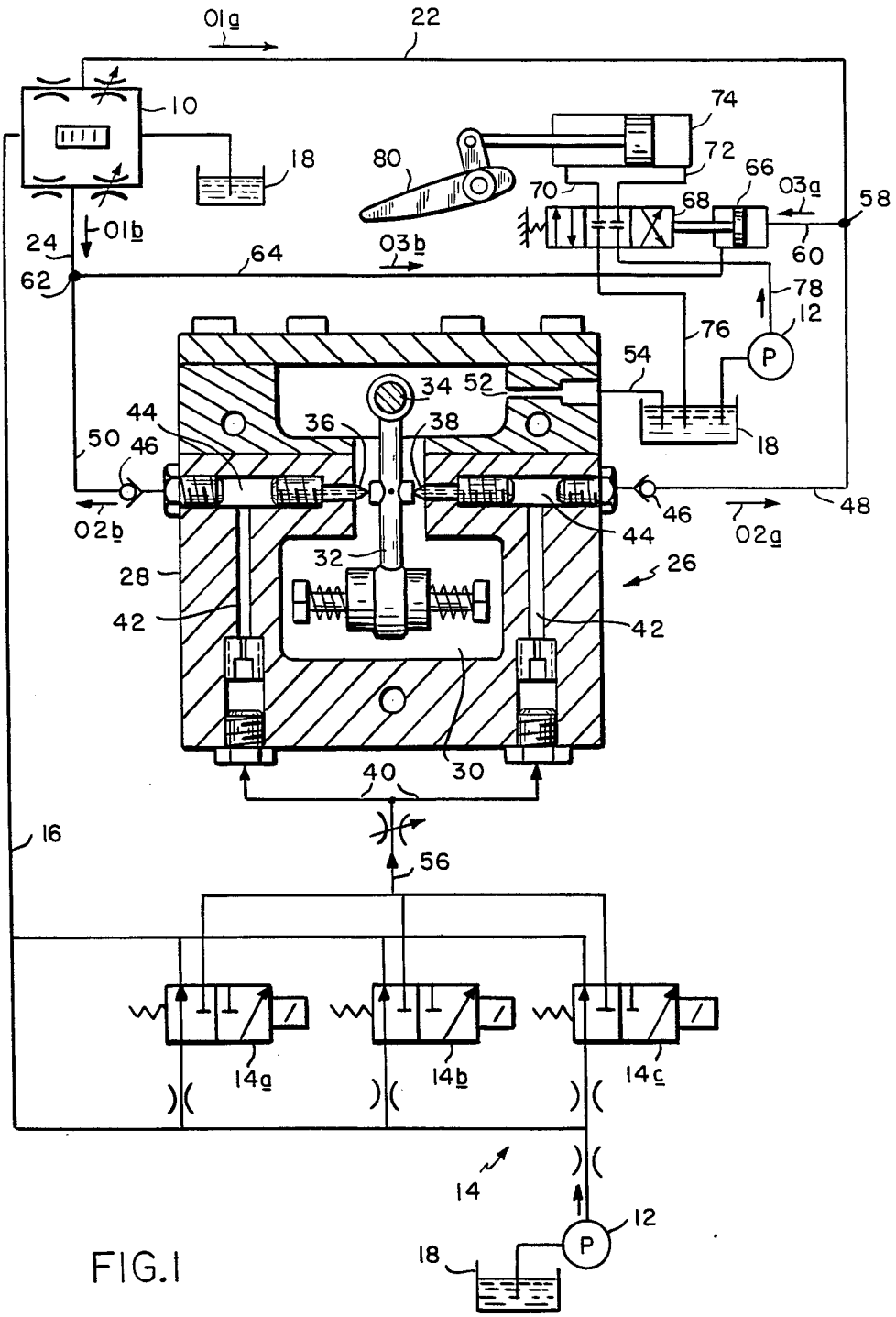
FIG. 1 is a partially schematic illustration of a first embodiment of the invention incorporating a sectional view through the pendulum-type sensor.

Referring initially to FIG. 1, a fin stabilizer system in accordance with the present invention is shown including a first sensing means comprising a rate gyroscope 10 of the type described in U.S. Pat. No. 3,756,262, the disclosure of which is incorporated herein by reference in its entirety. Rate gyroscope 10 is connected to a pump 12 or other like source of pressurized hydraulic fluid via a valve network 14 and a feed line 16, and to a reservoir 18 via drain line 20. The rate gyroscope senses the rate and direction of a rolling condition being experienced by a ship and generates representative differential hydraulic first output pressure signals $01_a$,$01_b$ via lines 22,24.

The system of FIG. 1 also includes a second sensing means comprising a pendulum-type sensor 26 having a housing 28 defining an interior chamber 30. A pendulum 32 is mounted within the chamber 30 for swinging movement about the axis of a support shaft 34. The pendulum is located between confronting restrictor orifices 36,38 which are fed with pressurized hydraulic fluid via lines 40 and passageways 42,44 drilled through the housing 28. The passageways 44 are also connected via check valves 46 to lines 48,50. The interior chamber 30 is connected via passageway 52 and discharge line 54 to reservoir 18. The lines 40 are connected via line 56 and valve network 14 to the pump 12.

The housing 26 is fixed in relation to the hull of the ship. Hydraulic fluid enters the housing chamber 30 via passageways 42,44 and orifices 36,38, and exits therefrom via passageways 52. Hydraulic fluid also exits from the passageways 44 via the check valves 46 and lines 48,50 to provide differential hydraulic second output signals $02_a$,$02_b$. The pressure level of the second output signals is dependent upon the pressure drop across the orifices 36,38, which in turn is dependent upon the position of the orifices in relation to the pendulum 32 interposed therebetween. When the ship is level, the pendulum 32 will be located exactly midway between the orifices 36,38, as illustrated in FIG. 1. The pressure drop across the orifices 36,38 will thus be equal, as will be second output pressure signals $02_a$,$02_b$. Any change in inclination of the housing 28 will, however, upset this balance.

The lines 22 and 48 are connected at juncture 58 to line 60, as are lines 24,50 at juncture 62 to line 64. The junctures 58,62 thus serve as integrating means which combine the respective first and second output pressure signals $01_a$,$02_a$, and $01_b$,$02_b$ into integrated output pressure signals $03_a$,$03_b$ carried respectively by lines 60,64 to a piston-cylinder assembly 66. The piston-cylinder assembly 66 adjusts the directional valve 68. Valve 68 is connected via lines 70,72 to a servo motor 74, and by lines 76,78 to the reservoir 18 and pump 12. The servo motor 74 is mechanically coupled to a stabilizer fin 80.

When the ship is under way in a sea likely to cause rolling, the rate gyroscope sensing device 10 will become active, generating first output pressure signals $01_a$,$01_b$ which will be directed to the piston-cylinder assembly 66 to effect appropriate adjustments to directional valve 68 and servo motor 74. Under list or side sway conditions, the pendulum-type sensor will likewise become active to produce second output pressure signals $02_a$,$02_b$ which also will operate the piston-cylinder assembly 66. When roll and list or side sway conditions are experienced simultaneously, as is usually the case when a ship is underway in heavy seas, the system will operate in a self-modulating manner to combine the first and second output pressure signals of both sensing devices into integrated third output signals $03_a$,$03_b$. When the sea conditions result in only one of the sensors being activated, then the third output signals $03_a$,$03_b$ will consist only of the pressure signals from that sensor since the other sensor will remain essentially inactive.

The valve network 14 will preferably include several feed valves **14*a*, 14*b*, 14*c*** which can be manually activated in a stepped fashion to adjust for varying sea conditions by gradually increasing or decreasing the amount of hydraulic control fluid being directed through the system.

Figure 2:
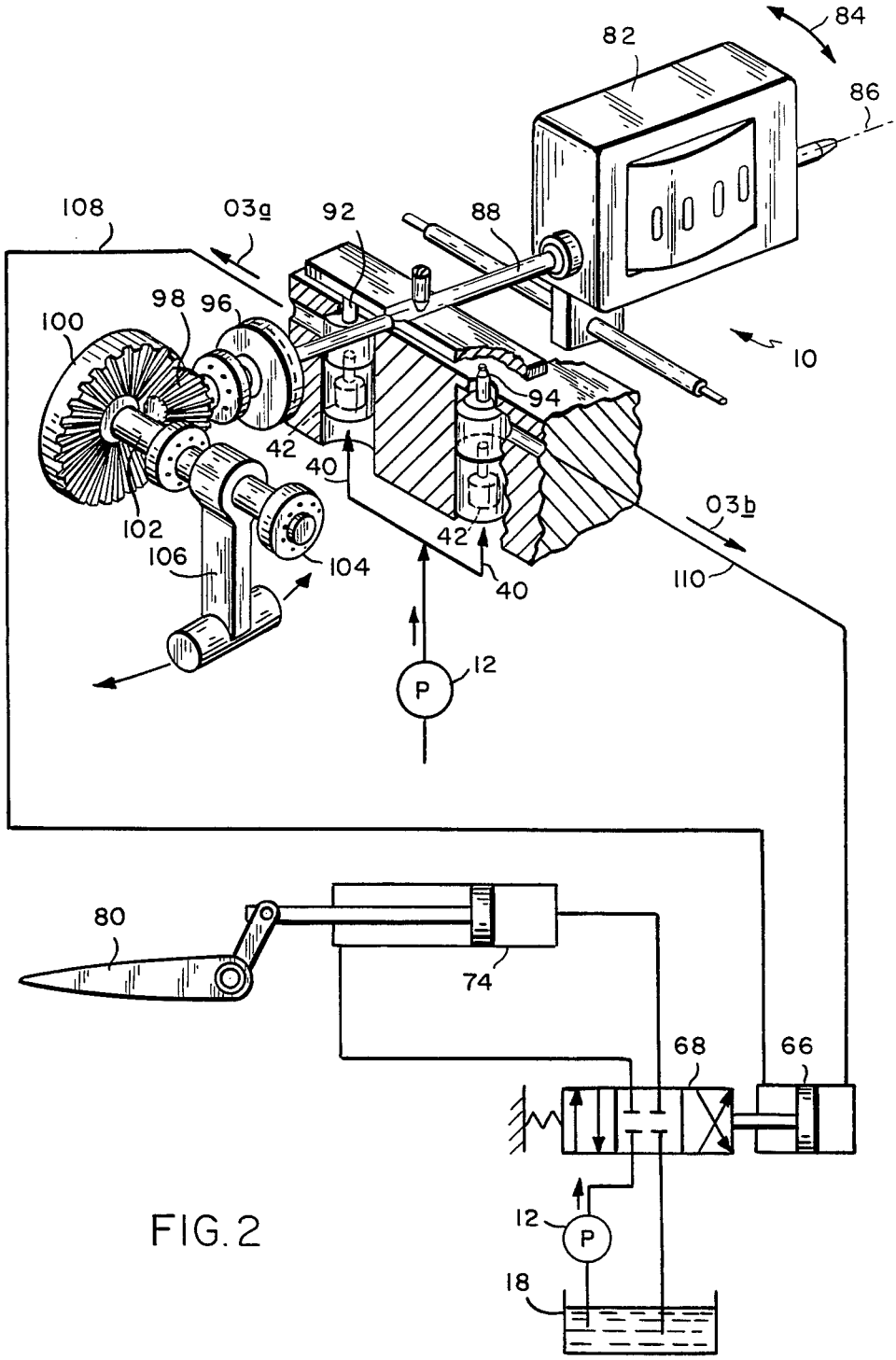
FIG. 2 is a partially schematic illustration of a second embodiment of the invention wherein the included pendulum-type sensor and rate gyroscope sensor are mechanically coupled.

Referring now to FIG. 2, an alternate embodiment of the invention is shown wherein the same reference numerals have been employed to identify those components that are the same or equivalent to those illustrated in FIG. 1. The gyroscopic cage 82 of the rate gyroscope 10 responds to the ship's roll by rotatably shifting as indicated by arrow 84 about the precession axis 86. A torsional shaft 88 is connected to the cage 82 and is coincident with the precession axis. A flapper 90 is carried by the shaft 88. The flapper overlies a pair of orifices 92,94 fed by high pressure hydraulic fluid from pump 12 via lines 56 and 40 and housing passageways 42.

Shaft 88 is also connected via clutch 96 to a bevel gear 98 which is in meshed relationship with a mating bevel gear 100 on a shaft 102 rotatably journalled between bearings 104. A pendulum 106 is fixed to and supported on the shaft 102 for pivotal motion in response to listing and/or side sway. When the clutch 96 is engaged, both the pendulum 106 and the gyroscopic cage 82 exert torsional forces on the connecting shaft 88. The torsional force of the cage 82 is representative of rolling conditions, whereas the torsional force of the pendulum 106 is representative of list or side sway. These forces are mechanically coupled by the shaft 88 and are transmitted to the flapper 90, which modulates the flow of hydraulic fluid through the orifices 92,94. The passageways 42 are connected via lines 108,110 to the piston-cylinder assembly 66, and the hydraulic output signals **03*a*,03*b* carried by the lines 108,110 result from the mechanical integration provided by connecting shaft 88 between the gyroscopic sensor and the pendulum-type sensor. The clutch 96** may be disengaged, thereby allowing only the gyroscopic sensor to remain actively coupled to the system.

Although not illustrated, it will be understood that other means, such as for example a linkage system, could be employed in place of the bevel gears 98,100 to establish a mechanical connection between the pendulum 106 and the shaft 108.

In light of the foregoing, it will now be understood by those skilled in the art that the systems represented by FIGS. 1 and 2 each provide means for effectively dealing with roll and/or list or side sway. The systems are self-modulating and fully hydraulic.

I claim:

1. A stabilizing system for counteracting the tendency of a ship while under way to experience rolling, listing, side swaying, or combinations of such conditions, said system comprising:

first sensing means including a rate gyroscope for sensing the rate and direction of a rolling condition being experienced by said ship and for generating a first output representative thereof;

second sensing means including a pendulum for sensing a listing or swaying condition being experienced by said ship and for generating a second output representative thereof;

integrating means for combining said first and second outputs into an integrated output;

said first, second and integrated outputs each comprising differential hydraulic pressure signals;

stabilizing fins adjustably mounted at submerged locations externally on said ship;

actuator means for adjusting said fins; and control means responsive to said integrated output for controlling said actuator means to adjust said fins and thereby counteract the conditions being sensed by said sensing means.

2. A stabilizing system for counteracting the tendency of a ship while under way to experience rolling, listing, side swaying, or combinations of such conditions, said system comprising:

first sensing means including a rate gyroscope for sensing the rate and direction of a rolling condition being experienced by said ship and for generating a first output representative thereof;

second sensing means including a pendulum for sensing a listing or swaying condition being experienced by said ship and for generating a second output representative thereof;

integrating means for combining said first and second outputs into an integrated output, said first and second outputs comprising torsional forces mechanically applied to a common shaft of said integrating means stabilizing fins adjustably mounted at submerged locations externally on said ship;

actuator means for adjusting said fins; and control means responsive to said integrated output for controlling said actuator means to adjust said fins and thereby counteract the conditions being sensed by said sensing means.

3. The stabilizing system of claim 2 wherein said integrating means combines and converts said torsional forces into an integrated differential hydraulic pressure signal.

4. The stabilizing system of claims 2 or 4 further comprising clutch means for selectively coupling and uncoupling said second output from said common shaft.

5. The stabilizing system of claims 1 or 2 further comprising means for selectively deactivating the output of said second sensing means.

6. The stabilizing system of claims 1 or 2 wherein said actuator means is hydraulically operated in response to fluid pressure received via said control means, and wherein said integrated output comprises a differential hydraulic pressure signal.

* * * * *